US005127584A

United States Patent [19]

Sczomak

[11] Patent Number: 5,127,584

[45] Date of Patent: Jul. 7, 1992

[54] FUEL INJECTION NOZZLE

[75] Inventor: David P. Sczomak, Troy, Mich.

[73] Assignee: General Motors Corporation, Detroit, Mich.

[21] Appl. No.: 696,909

[22] Filed: May 6, 1991

[51] Int. Cl.[5] ..... F02M 61/08

[52] U.S. Cl. ..... 239/533.11; 239/533.3; 239/533.12; 239/584

[58] Field of Search ..... 239/533.2, 533.3, 533.7, 239/533.9, 533.11, 533.12, 584

[56] References Cited

U.S. PATENT DOCUMENTS

| | | | |
|---|---|---|---|
| 2,592,111 | 4/1952 | Bischof | 239/533.7 |
| 2,750,957 | 6/1956 | Tavola | 239/533.11 |
| 3,139,076 | 6/1964 | Flaherty . | |
| 3,314,303 | 4/1967 | Maat . | |
| 4,151,958 | 5/1979 | Hofmann | 239/533.3 |
| 4,382,554 | 5/1983 | Hofmann | 239/533.9 |
| 4,693,424 | 9/1987 | Sczomak | 239/533.11 |
| 4,747,376 | 5/1988 | Speil et al. . | |
| 4,750,675 | 6/1988 | Sczomak | 239/533.11 |
| 4,905,908 | 3/1990 | Sczomak | 239/533.12 |
| 4,909,444 | 3/1990 | Sczomak | 239/533.12 |

FOREIGN PATENT DOCUMENTS

| | | | |
|---|---|---|---|
| 3113475 | 10/1982 | Fed. Rep. of Germany | 239/533.9 |
| 22071 | 2/1985 | Japan | 239/533.3 |
| 1005355 | 9/1965 | United Kingdom | 239/533.3 |

OTHER PUBLICATIONS

Sczomak, "The Poppet Covered Orifice Fuel Injection Nozzle," SAE Technical Paper 900821, Feb. 26, 1990.

*Primary Examiner*—Andres Kashnikow
*Assistant Examiner*—William Grant
*Attorney, Agent, or Firm*—Karl F. Barr, Jr.

[57] ABSTRACT

A fuel injection nozzle for use in an internal combustion engine has a spray tip with a spring biased poppet valve journaled for reciprocable movement therein. The poppet valve has a fuel supply passage extending through the stem thereof for flow communication with fuel spray orifices that are located so as to discharge fuel in a predetermined spray pattern upon outward opening movement of the poppet valve. The nozzle has an integral locating and secondary stop assembly comprising complimentary grooves formed in the nozzle body and the valve stem of the poppet valve which, when aligned, form a cylindrical positioning bore which is adapted to receive a locating ball. The ball acts through interference at the nozzle-stem interface to prevent rotation of the poppet valve relative to the nozzle body and additionally acts to limit outward movement of the valve from the nozzle body by an interference with the upper shoulder of the positioning slot.

2 Claims, 1 Drawing Sheet

FUEL INJECTION NOZZLE

BACKGROUND OF THE INVENTION

1. Field of the Invention

This invention relates to liquid fuel injection nozzles for internal combustion engines and, in particular, to an injection nozzle of the outwardly opening poppet valve type particularly suited for installation in an engine where a predetermined fuel spray pattern is desired.

2. Description of the Relevant Art

Fuel injection nozzles of the outwardly opening, poppet valve type for use in diesel engines are well known. In this type of injection nozzle there is provided a closure member, in the form of a poppet valve, that is movable to an open position relative to an associated valve seat by fuel pressure pulses from a high pressure fuel pump. The valve is movable to a closed position in seating engagement with the valve seat by a return spring which acts on the valve stem of the poppet valve upon cessation of the high pressure fuel pulse.

Examples of fuel injection nozzles having many features of the present nozzle are disclosed, for example, in U.S. Pat. No. 4,693,424 issued Sep. 15, 1987, U.S. Pat. No. 4,905,908 issued Mar. 6, 1990, and U.S. Pat. No. 4,909,444 issued Mar. 20, 1990 in the name of David P. Sczomak.

The injector nozzles described in the above references have been limited to cylinder head installations in which the fuel spray pattern is symetric about the injector nozzle. These installations are generally in a near vertical orientation. The poppet valves are free to rotate within the nozzle body with minimal effect on engine performance due to the substantially symmetric fuel spray pattern. Such injector nozzles are not well suited to angled installations or installations where predetermined fuel spray patterns are desired since poppet valve rotation adversely affects the spray pattern and, as a result, engine performance.

SUMMARY OF THE INVENTION

It is therefore a primary object of the present invention to provide an improved fuel injection nozzle for use in an internal combustion engine that is operable in a manner which allows a predetermined spray pattern to be achieved without regard to nozzle orientation. A nozzle locator having a locator ball residing in a groove formed cooperatively between the poppet valve stem and the nozzle body inhibits relative rotation therebetween.

A further object of the invention is to provide an improved fuel injection nozzle of the outwardly opening poppet valve type wherein the stem of the poppet valve is restrained from movement into the combustion chamber of the engine by action of the locator ball against the upper shoulder of the poppet valve stem groove.

Other objects and features of the invention will become apparent by reference to the following description and to the drawing.

DESCRIPTION OF THE PREFERRED EMBODIMENT

Figure 1:
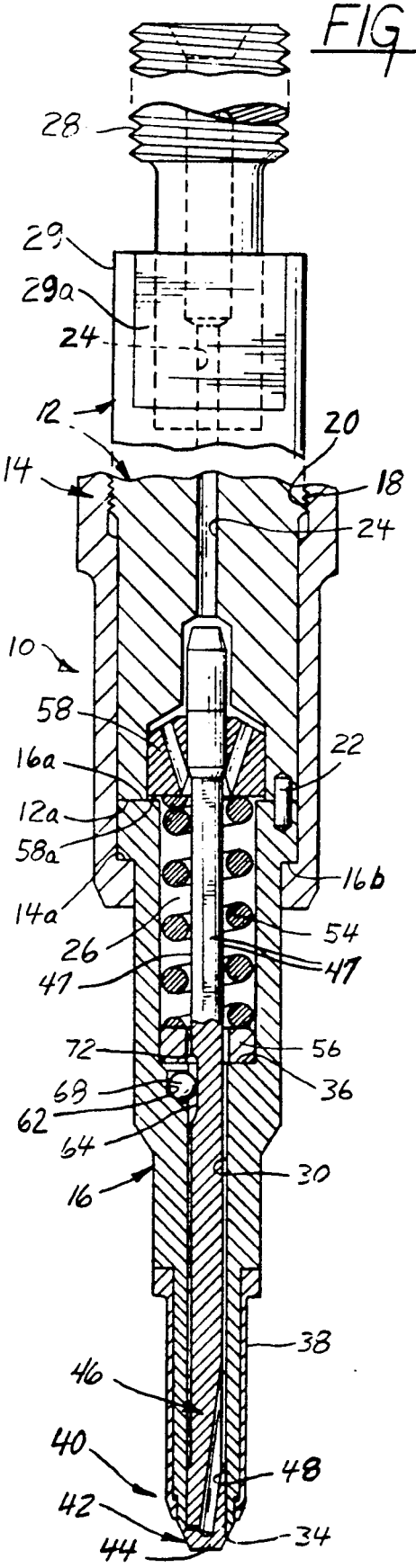
FIG. 1 is a plan view, partially in section of a fuel injector assembly embodying the present invention.

In FIG. 1 there is illustrated a preferred embodiment of an outward opening, poppet covered orifice fuel injection nozzle, designated generally as 10, constructed in accordance with the present invention. The fuel injection nozzle 10 is of a type that is adapted to be mounted, for example, in a suitable nozzle receiving socket for this purpose in the cylinder head (not shown) of an internal combustion engine with the spray tip end thereof suitably located so as to discharge fuel into an associated combustion chamber of the engine in a predetermined desired spray pattern.

The poppet covered orifice fuel injection nozzle (PCO nozzle) 10, in the construction illustrated, is provided with a multi-piece nozzle housing that comprises a tubular inlet fitting 12, a tubular nut 14 and a nozzle body 16 suitably secured together in a conventional manner. The inlet fitting 12 is secured to the tubular nut 14 by threaded engagement of the external threads 18 thereof with the internal threads 20 at the upper end of the tubular nut 14. The upper end surface **16*a* of the nozzle body 16 abuts against the lower face 12*a* of the inlet fitting 12 and its downwardly facing retaining shoulder 16*b* abuts against the internal shoulder 14*a* of the tubular nut 14. A dowel pin 22 inserted in pin bores formed in the faces 12*a* and 16*a* prevents rotation of nozzle body 16 in the assembles PCO nozzle 10**.

The inlet fitting 12 is provided with an axially extending stepped bore therethrough forming an inlet passage 24 extending from the upper or free end of the fitting 12 to open at its lower end, as viewed in FIG. 1, into a cylindrical fuel chamber 26. In addition, the inlet fitting 12 is provided with suitable external connector means such as threads 28 or other suitable connector to which a fuel supply (not shown) can be secured thereto so that the injection nozzle 10 can be intermittently supplied with fuel, for example as by a high pressure fuel pump (not shown) in a conventional manner. An enlarged external diameter portion 29 having opposed flats **29*a* effect attachment of nozzle 12** to a cylinder head as by a clamp or yoke, not shown, in a well known manner. The clamp minimizes movement of the nozzle relative to the cylinder head.

Nozzle body 16, of stepped external cylindrical configuration, is provided with an axially extending stepped bore therethrough so as to define the lower portion of fuel chamber 26 at its upper, inlet end, and an intermediate fuel passage 30, which at its lower, free end is encircled by a frusto-conical valve seat 34 of a predetermined included angle. Fuel chamber 26 and a fuel passage 30 are connected by a flat shoulder 36. The lower outer peripheral end of nozzle body 16 may be stepped to receive shield 38 which may be useful to protect the end of the nozzle body from high temperatures present in the combustion chamber. The shield 38 insulates the nozzle body tip thereby minimizing the tendency for damage due to overheating. Additionally, spray tip 40 of nozzle body 16 is chamfered so as to improve the injection performance of the injector nozzle as is well known.

Figure 2:
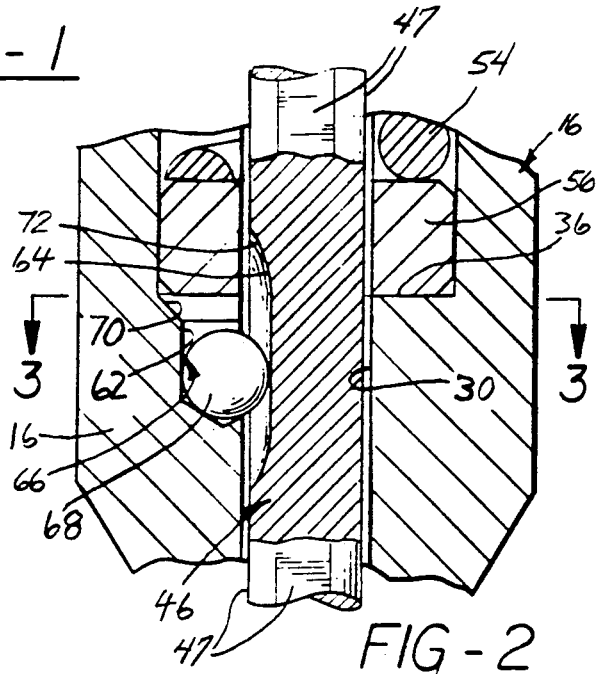
FIG. 2 is an enlarged sectional view of a portion of the fuel injector of FIG. 1 showing details of the poppet valve locator assembly.

Fuel discharge from the spray tip 40 of the nozzle body 16 is controlled by means of an injection valve in the form of a poppet valve 42, that includes a head 44 with an elongated valve stem 46 extending therefrom. The lower portion of the valve stem 46 is of a predetermined external diameter wherein it is reciprocably and sealingly guided within fuel passage 30. The intermediate portion of valve stem 46 has axially extending flats 47, shown in FIGS. 2 and 3, which minimize the extent of contact with the fuel passage wall 30 and provide for the flow of fuel from fuel chamber 26 to the valve head 44.

Figure 4:
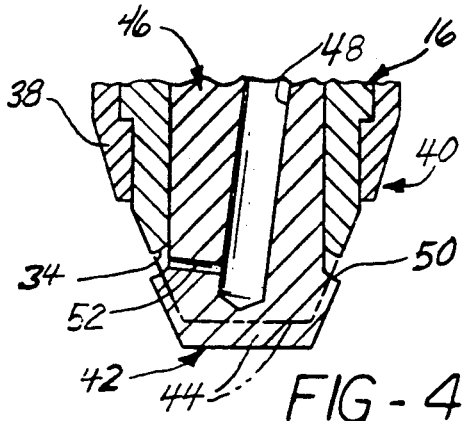
FIG. 4 is an enlarged sectional view of the nozzle tip of the fuel injector of FIG. 1.

The head 44 of the poppet valve 42 is preferably of a predetermined maximum external diameter corresponding to the external diameter of the valve seat 34 of the nozzle body 16 and is provided with an annular frustoconical valve seat surface 50, shown in FIG. 4, to effect seating engagement against valve seat 34, shown in phantom in FIG. 4. Extending from a position within the intermediate portion of the valve stem to the interior of the valve head 44 is fuel passage 48 which opens to a plurality of radially outwardly extending fuel discharge orifices 52. Although it is common for the discharge orifices to be oriented to produce a fuel spray pattern which is symmetrical about the nozzle 10, in particular applications, namely those which require the injector nozzle to be mounted in a non-vertical, non-central position within the cylinder head, a predetermined, nonsymmetrical fuel spray pattern may be desired.

The poppet valve 42 is normally biased to a valve closed position relative to the valve seat 34 by means of a valve return spring 54 encircling that portion of the valve stem disposed within the fuel chamber 26. One end of the spring abuts against a retainer shim or washer 56 of predetermined thickness. The opposite or upper end of the spring 54 abuts against the lower surface of spring keeper-primary stop 58 which is suitably fixed to the upper, free end portion of the valve stem 46. The spring keeper is formed so as to be of a cylindrical configuration with an outside diameter suitably less than the internal diameter of that portion of the fuel chamber formed within the tubular inlet fitting in which it is disposed for reciprocable movement, but larger than that portion of the fuel chamber 26 formed within the nozzle body. With the above arrangement, since the lower surface **58*a* of spring keeper-primary stop 58 is positioned so as to abut against the upper end surface 16*a* of nozzle body 16, opening movement of the poppet valve 42** is limited thereby preventing the valve from entering the combustion chamber beyond a desired predetermined distance.

Figure 3:
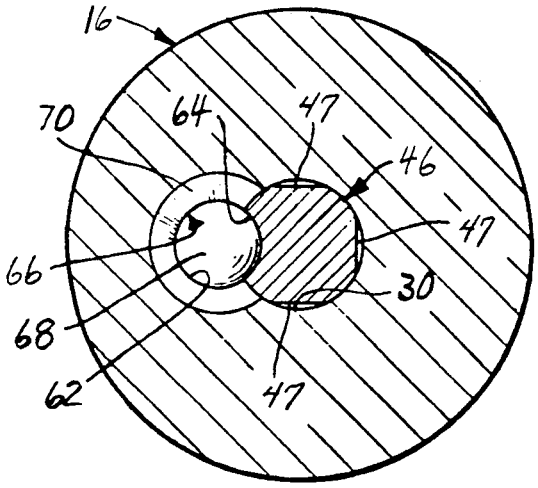
FIG. 3 is an enlarged sectional view taken along line 3—3 of FIG. 2 showing details of the poppet valve locator assembly.

As earlier described, a predetermined fuel discharge pattern requires that the poppet valve head remain stationary. That is, in order to achieve the desired pattern, the poppet valve 42 must be prevented from rotating relative to its placement within the cylinder head. As shown it FIGS. 1, 2, and 3, the nozzle body 16 is provided with an axially extending locating bore 62 extending downwardly a predetermined distance from shoulder 36 at the lower end of fuel chamber 26. The bore is placed off-center from the axis of the nozzle body 16 and is of a diameter which partially intersects the fuel passage 30. A valve positioning slot 64 is formed in the side of the valve stem, intermediate the upper free end and the head 44. The slot 64 is formed in the valve stem by nose milling or other suitable machining operation. As shown in FIG. 3, the slot radius is chosen to be substantially the same as that of the locating bore 62 so that upon alignment therewith the bore 62 and slot 64 form a cylindrical bore 66 which receives locating ball 68 therein. The locating ball is inserted within cylindrical bore 66 during the assembly of the valve stem 46 within nozzle body 16 and is retained within cylindrical bore 66 by retainer shim 56. A chamber 70 extending about the opening of locating bore 62 aides in the insertion of the ball within cylindrical bore 66 by guiding it from the edge of the flat shoulder 36 into the bore. As is best shown in FIG. 1, valve positioning slot 64 has an axial length which is sufficient to facilitate insertion of the locating ball 68 into cylindrical bore 66 and also to allow valve stem 46 to reciprocate freely during operation. The locating ball 68 prevents rotation of the valve stem 46 relative to nozzle body 16 which in turn is positionally fixed by dowel pin 22 with respect to inlet fitting 12 thereby assuring that the valve head 44 remains positionally fixed relative to the combustion chamber of the engine thereby assuring the desired fuel spray pattern.

The outwardly opening design of the PCO nozzle requires that the poppet valve 42 be securely restrained within the nozzle body 16 to prevent its incursion into the combustion chamber beyond that required for normal operation. As described above, spring keeper-primary stop 58 acts against the upper end surface **16*a* of the nozzle body 16 to limit downward, or outward travel of the poppet valve. The nozzle locator assembly described, acts as a secondary valve stop should the spring keeper-primary stop 58 be damaged in a manner that would allow the valve 42 to drop from the nozzle body 16. In such an instance, the poppet valve 42 would be limited in its downward, or outward travel by the locating ball 68 contacting the upper shoulder 72 of positioning slot 64** thereby preventing the valve from contacting the piston within the cylinder of the engine.

The poppet covered orifice fuel injector nozzle of the present invention is suited for installations within the cylinder head of an internal combustion engine which require predetermined fuel spray patterns presenting the engine designer with greater flexibility in combustion chamber and other component designs. The PCO fuel injector nozzle disclosed utilizes a simple, and completely internal poppet valve locator for preventing undesirable rotation of valves having such specific fuel spray patterns. The internal design eliminates leakage concerns inherent with externally inserted positioning dowels. Furthermore, the poppet valve locator functions as a secondary poppet valve stop, preventing incursion of the valve into the combustion chamber should the primary valve travel limiter fail.

While certain embodiments of the invention have been described in detail above in relation to a poppet type fuel injection nozzle, it would be apparent to those skilled in the art that the disclosed embodiment may be modified. Therefore, the foregoing description is to be considered exemplary, rather than limiting, and the true scope of the invention is that described in the following claims.

The embodiments of the invention in which an exclusive property or privilege is claimed are defined as follows:

1. A fuel injection nozzle comprising:

a nozzle body having a fuel passage extending axially and configured to receive the stem of a poppet valve for reciprocable movement therein;

a locating bore extending axially into said nozzle body from one end thereof, said locating bore positioned off-center from said fuel passage with the circumference of said locating bore intersecting the perimeter of said fuel passage;

an axially elongated valve positioning slot formed in the side of said valve stem having a predetermined length delimited by an upper shoulder and a radius substantially equal to the radius of said locating bore wherein alignment of said locating bore with said valve positioning slot will form a cylindrical positioning bore therebetween;

a locating ball disposed in said cylindrical positioning bore to inhibit rotation of said poppet valve stem relative to said nozzle body while facilitating reciprocable axial movement therebetween and to limit outward movement of said poppet valve from said nozzle body by interference of said locating ball with the upper shoulder of said valve positioning slot; and means for closing said cylindrical positioning bore to prevent egress of said locating ball therefrom.

2. A fuel injection nozzle having an inlet for pressurized fuel at one end thereof, a spray tip at the opposite end thereof and having an axially extending through bore of predetermined internal diameter therein, an outwardly opening poppet valve operatively positioned within said nozzle, said poppet valve including an annular head portion with a valve seat surface positioned for movement between a closed position and an outward opened position and a stem extending from said head portion that is received for reciprocable sliding movement in said bore, said poppet valve having internal passage means in fluid communication at one end with said inlet and terminating at its other end in fuel discharge means that are located so as to discharge fuel in a predetermined spray pattern upon outward opening movement of said head portion, an integral valve locator disposed within said nozzle, said locator comprising a locating bore extending axially into said nozzle a predetermined distance and positioned off-center from said through bore with a circumference intersecting the perimeter of said through bore, an axially elongated positioning slot formed in the side of said valve stem having a predetermined length delimited by an upper shoulder and a radius substantially equal to the radius of said locating bore wherein alignment of said locating bore with said positioning slot will form a cylindrical positioning bore therebetween, and a locating ball operatively disposed within said cylindrical positioning bore to prevent rotation of said poppet valve stem relative to said nozzle by creating an interference at the nozzle valve stem interface while facilitating reciprocable axial movement therebetween and to limit outward movement of said poppet valve from said nozzle by interference of said locating ball with the upper shoulder of said positioning slot.

* * * * *